US005785506A

United States Patent [19]

Takahashi et al.

[11] Patent Number: 5,785,506

[45] Date of Patent: Jul. 28, 1998

[54] LIQUID FEEDING PUMP

[75] Inventors: Kiyozumi Takahashi, Kanagawa-ken; Shigeyoshi Komaki, Tokyo, both of Japan

[73] Assignee: Ahresty Corporation, Tokyo, Japan

[21] Appl. No.: 575,394

[22] Filed: Dec. 20, 1995

[30] Foreign Application Priority Data

Dec. 21, 1994 [JP] Japan ..... 6-318209

[51] Int. Cl.[6] ..... F04B 17/00; F04B 39/06

[52] U.S. Cl. ..... 417/366; 417/403

[58] Field of Search ..... 417/366, 398, 417/399, 401, 403; 92/170.1

[56] References Cited

U.S. PATENT DOCUMENTS

| | | | |
|---|---|---|---|
| 1,353,216 | 9/1920 | Carlson | 417/401 |
| 1,941,766 | 1/1934 | Thom | 417/403 |
| 3,180,527 | 4/1965 | Wasilewski et al. | 417/403 |
| 4,895,497 | 1/1990 | Schlinkheider | 417/403 |
| 5,013,198 | 5/1991 | Schultz | 417/287 |
| 5,092,746 | 3/1992 | Henke | 417/403 |
| 5,131,818 | 7/1992 | Witkop et al. | 417/273 |

FOREIGN PATENT DOCUMENTS

| | | | |
|---|---|---|---|
| 515687 | 12/1939 | United Kingdom | 417/403 |

*Primary Examiner*—Charles G. Freay
*Assistant Examiner*—Peter G. Kurytnyk
*Attorney, Agent, or Firm*—Watson Cole Stevens Davis, P.L.L.C.

[57] ABSTRACT

A liquid feeding pump includes two coaxial cylinder chambers, a piston mounted in each chamber, and a piston rod connecting the pistons. A head side of one cylinder chamber functions as a liquid chamber, a rod side functions as a first air chamber, a rod-side of the other cylinder chamber functions as a second air chamber, and a head side functions as a third air chamber. The liquid chamber is formed with liquid inlets or outlets. Each of the air chambers is formed with air inlets or outlets, a part of the supplying pipes connected to the liquid inlet or outlet of the liquid chamber is wound around an outer periphery of the other cylinder chamber, or a peripheral wall of the other cylinder chamber is formed with a liquid cooling chamber and supplying pipes communicated with and connected to the liquid inlets or outlets of the liquid chamber are connected to the liquid cooling chamber.

6 Claims, 2 Drawing Sheets

LIQUID FEEDING PUMP

FIELD OF THE INVENTION AND RELATED ART STATEMENT

This invention relates to a liquid feeding pump for use in supplying coolant liquid such as water or the like to a die or a core pin in a die casting operation.

When cooling water is supplied to a die or core pin during die casting the lower discharging pressure may not suffice to convey sufficient cooling water into the many fine cooling holes of the die. Further, when a boiling film of cooling water is generated within the cooling holes, the boiling film must be covered by the cooling water so as to cool it, resulting in the requirement that the discharging pressure be relatively high. As such, a relatively large-sized liquid feeding pump capable of providing a high discharging pressure may be needed.

OBJECT AND SUMMARY OF THE INVENTION

It is an object of the present invention to provide a small sized liquid feeding pump capable of providing a relative high discharging pressure.

It is another object of the present invention to provide a liquid feeding pump in which a smooth liquid feeding operation (via movement of a piston) can be carried out and which has a simple and inexpensive configuration.

It is a still further object of the present invention to provide a liquid feeding pump in which fed liquid can be cooled and supplied without requiring any special cooling device.

The inventive liquid feeding pump which accomplishes these objects is characterized in that each of its pistons is mounted in one of two cylinder chambers which are coaxially arranged, both pistons being connected by a piston rod, a piston head side of one cylinder chamber functioning as a liquid chamber, its piston rod side functioning as a first air chamber, a piston rod side in the other cylinder chamber functioning as a second chamber, and a head side functioning as a third air chamber. The liquid chamber is formed with liquid inlet and outlet connections, each of the first air chamber, the second air chamber and the third air chamber is formed with an air inlet and an air outlet, respectively, and when liquid is discharged out of the liquid chamber, the air inlet and outlet of the second air chamber are released to supply high pressure air to the first and third air chambers, and in turn, when liquid is fed into the liquid chamber, the air inlet and outlet of the first and third air chambers are released to supply high pressure air to the second air chamber.

In addition, it is also one of the aspects of the present invention that one or a plurality of cylinder chambers having a larger diameter than a cylinder diameter of the other cylinder chamber are coaxially arranged with the other cylinder chamber, a piston connected to the piston rod is mounted in the cylinder chambers to form an air chamber.

It is also one of the aspects that peripheral walls of both two cylinder chambers or a peripheral wall of at least one cylinder chamber are formed by a resin member arranged in the cylinder chambers and slidably contacted with the piston and by a metallic member fitted and arranged outside the resin member.

Further, it is a still further aspect of the present invention to wind a part of a supplying pipe communicated with and connected to the liquid inlet or outlet of the liquid chamber around an outer periphery of the other cylinder chamber.

In addition, it is a further aspect of the present invention to form a liquid cooling chamber at a peripheral wall of the other cylinder chamber and connect the supplying pipe communicated with and connected to the liquid inlet or outlet of the liquid chamber to the liquid cooling chamber.

DETAILED DESCRIPTION OF THE PREFERRED EMBODIMENTS

Figure 1:
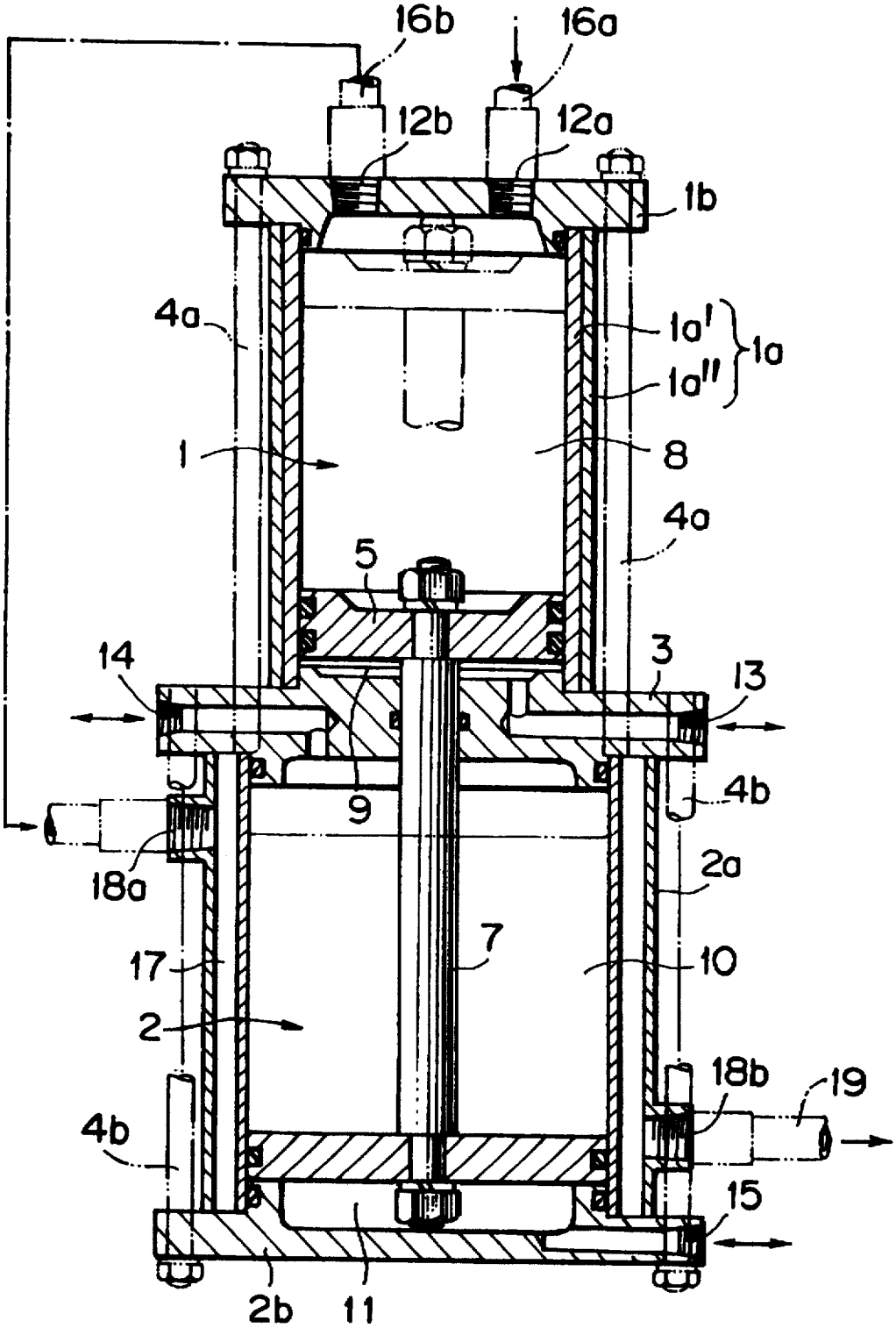
FIG. 1 is a sectional view of a first preferred embodiment of liquid feeding pump according to the present invention.

Referring now to FIG. 1, one preferred embodiment of the present invention will be described.

Reference numeral 1 denotes one cylinder chamber formed by a cylindrical peripheral wall 1*a*, a top disk 1*b* and a partition disk 3. Reference numeral 2 denotes the other cylinder chamber formed by a cylindrical peripheral wall 2*a* which is larger than that of the one cylinder chamber 1, a bottom disk 2*b* and the partition disk 3.

One cylinder chamber 1 and the other cylinder chamber 2 are each divided by the partition disk 3 into an upper segment and a lower segment and coaxially arranged from each other. Each of the pistons 5 and 6 is slidably mounted within one cylinder chamber 1 and the other cylinder chamber 2, these both pistons 5 and 6 are integrally connected to each other by one piston rod 7 and driven in a vertical direction in the manner of piston as an integrated body.

Reference numeral 4*a* FIG. 1 denotes connecting rods for connecting the top disk 1*b* of one cylinder chamber 1 to the partition disk 3 so as to hold the peripheral wall 1*a*. Reference numeral 4*b* in this figure denotes connecting rods for connecting the bottom disk 2*b* of the other cylinder chamber 2 to the partition disk 3 so as to hold the peripheral wall 2*a*.

The peripheral wall 1*a* of cylinder chamber 1, is formed by an inner resin material member 1*a*' which is slidably contacted by the piston 5, and an outer metallic material member 1*a*". The wall 2*a* of cylinder chamber 2 can be similarly constructed.

One cylinder chamber 1 is formed with a liquid chamber 8 for feeding and discharging liquid such as water and the like, so that lubrication with lubricant may not be performed. Application of lubricant causes the lubricant to be mixed with water in the cylinder chamber 1 to generate emulsion-like product and this product may clog the inlet or outlet for liquid or the inlet or outlet for air.

In view of the foregoing, if there is no lubrication, the metallic peripheral wall 1*a* may easily generate biting when the metallic piston 5 slides and irrespective of this fact, if the peripheral wall 1*a* is formed only with resin material, a bulging is produced due to occurrence of phenomenon of creep under a repetitive application of inner pressure unless the peripheral wall 1*a* is formed to have a substantial wall thickness, resulting in that a poor water-sealing with the piston 5 is produced and then the resin member 1*a*' formed into a cylindrical shape with resin materials such as polyethylene or polyacetal, nylon, fluorine resin and the like having superior sliding characteristic or anti-wearness is arranged inside, and the metallic member 1*a*" formed into a cylindrical shape with metallic material such as stainless steel in order to restrict bulging of the resin member 1a' is press-fitted outside the inner one to form the peripheral wall 1a.

In addition, the peripheral wall 2a of the other cylinder chamber 2 may be formed into a double-cylinder shape with the resin member and the metallic member in the same manner as that of the peripheral wall 1a of one cylinder chamber 1, although it may be formed only with the metallic member of stainless steel material.

Then, the head side of one cylinder chamber 1 is applied as the liquid chamber 8, the rod side of the chamber is applied as the first air chamber 9, the rod side of the other cylinder 2 is applied as the second air chamber 10 and the head side of the chamber is applied as the third air chamber 11. In this case, in order to increase a liquid discharging pressure against the air pressure (an increased pressure is applied), the diameter of the piston 6 mounted in the other cylinder chamber 2 is formed to be larger than that of the piston 5 mounted in one cylinder chamber 1.

In addition, the liquid chamber 8 is formed with liquid inlet or outlet 12a, 12b and each of the first air chamber 9, the second air chamber 10 and the third air chamber 11 is formed with air inlets or outlets 13, 14 and 15, respectively, wherein supplying pipes 16a, 16b are connected to the liquid inlets or outlets 12a, 12b of the liquid chamber 8, and each of the air inlets or outlets 13, 14, 15 is connected to an air supplying source through solenoid valves.

More practically, the top disk 1b of one cylinder chamber 1 is formed with the liquid inlet 12a and the liquid outlet 12b communicating with the liquid chamber 8, the partition disk 3 is formed with the first air inlet or outlet 13 communicating with the first air chamber 9 of one cylinder chamber 1, formed with the second air inlet or outlet 14 communicating with the second air chamber 10 of the other cylinder chamber 2 and the bottom disk 2b of the other cylinder chamber 2 is formed with the third air inlet or outlet 15 communicated with the third air chamber 11. In this way, the liquid inlets or outlets 12a, 12b or thy air inlets or outlets 13, 14, 15 are not formed at the peripheral walls 1a, 2a of the cylinder chambers 1, 2 but formed at the top disk 1b or the partition disk 3 or the bottom disk 2b, thereby manufacturing of the device can be easily performed, air-tightness within the cylinder chambers 1 and 2 can be facilitated and a trouble such as a leakage of pressure can be reduced.

Figure 2:
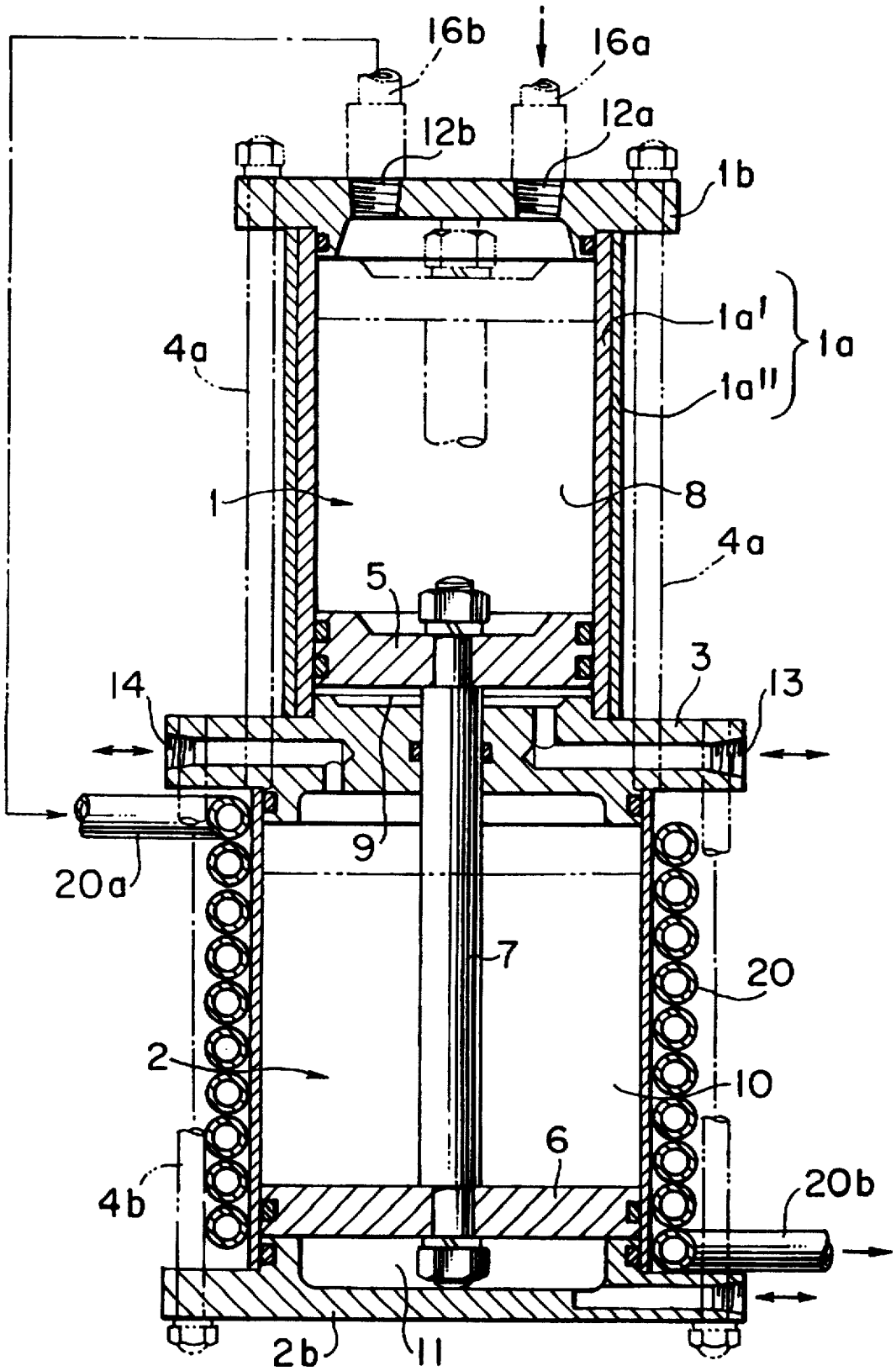
FIG. 2 is a sectional view of a second preferred embodiment.

As shown in FIG. 2, a part of the supplying pipes 16a, 16b communicated with and connected to liquid inlets or outlets 12b, 12b of the liquid chamber 8 can be closely wound and arranged at the outer periphery of the peripheral wall 2a of the other cylinder chamber 2 via inlet and outlet means 20a, 20b. As shown in FIG. 1, a liquid cooling chamber 17 can be instead formed to enclose the peripheral wall 2a of the other cylinder chamber 2 as shown in the preferred embodiment, the supplying pipe 16a or 16b (the supplying pipe 16b in the preferred embodiment) communicated with and connected to the liquid inlets or outlets 12a, 12b of the liquid chamber 8 is connected to the liquid inlet 18a of the liquid cooling chamber 17, and then a connecting hose 19 is connected to the liquid outlet 18b of the liquid cooling chamber 17.

Then, operation of the liquid feeding pump of the present invention will be described as follows.

At first, if high pressure air of about 0.5 Mpa to 1.0 Mpa, for example, is supplied into the first air chamber 9 and the third air chamber 11 through air inlets or outlets 13, 15 under a condition in which the pistons 5, 6 within one cylinder chamber 1 and the other cylinder chamber 2 are placed at their lower limit positions, liquid such as water or the like is filled in the liquid chamber 8 of the upper cylinder 1 and air within the second air chamber 10 is released to surrounding atmosphere through air inlet or outlet 14, the pistons 5, 6 are pushed up to the upper limit position to cause liquid within the liquid chamber 8 to be discharged out of the liquid outlet 12b through the supplying pipe 16b.

Then, after the air inlet or outlet 13 of the first air chamber 9 and the air inlet or outlet 15 of the third air chamber 11 are released to surrounding atmosphere, high pressure air is supplied from the air inlet or outlet 14 into the second air chamber 10 in the same manner as that described above, resulting in that the pistons 5 and 6 are pushed down to the lower limit positions and the liquid is supplied from the liquid inlet 12a into the liquid chamber 8 through the supplying pipe 16a. In this way, the high pressure air is released to surrounding atmosphere at each of the stages to cause the air in the first air chamber 9, the air in the second air chamber 10 and the air in the third air chamber 11 to be released at once through each of the air inlets or outlets 13, 14, 15 to make a thermal insulated expansion to cause temperatures within the first air chamber 9, the second air chamber 10 and the third air chamber 11 to be lowered.

Through this repetitive operation, liquid is sent from the liquid chamber 8 to a predetermined location through the supplying pipe 16b and concurrently temperatures in the first air chamber 9 and the other cylinder chamber 2 are decreased. Accordingly, in the case that a part of the supplying pipes 16a, 16b communicated with and connected to the liquid inlets or outlets 12a, 12b of the liquid chamber 8 is closely wound around the outer periphery of the other cylinder chamber 2 and installed there, liquid is cooled while it passes through a part of the liquid supplying pipes 16a, 16b and in turn in the case that a liquid cooling chamber 17 is formed at the peripheral wall 2a of the other cylinder chamber 2. The supplying pipes 16a, 16b connected to the liquid chamber 8 are connected to the liquid cooling chamber 17, the liquid is cooled while staying in the liquid cooling chamber 17.

Although not shown in the drawing, one or a plurality of other cylinders can be coaxially arranged at the lower part of the other cylinder chamber 2, the pistons connected to the piston rod 7 can be mounted to form the air chamber. In this case, it is preferable that the cylinder chamber is formed to be a larger diameter than a cylinder diameter of the other cylinder chamber 2. With this arrangement as above, the pressure is increased against the aforesaid one cylinder chamber 1 and the other cylinder chamber 2 so as to enable a more higher discharging pressure to be attained.

The liquid feeding pump of the present invention has the following effects.

High pressure air can be concurrently supplied to the two air chambers (the first and the third air chambers) to enable liquid in one liquid chamber to be discharged and sent, so that a high discharging pressure can be obtained even by a small-volume pump and even in the case that the cylinder diameter of the second cylinder chamber is formed to be larger than that of the first cylinder chamber to increase the pressure within the first cylinder, a higher increasing in pressure can be attained even though a ratio between both cylinder diameters is low, thereby it is possible to get a small-sized pump.

Pressure can be applied in the liquid chamber of one cylinder chamber in cooperation with the other cylinder chamber and concurrently it is possible to apply an increased pressure against one cylinder and the other cylinder, resulting in a higher discharging pressure being attained.

Then, according to the liquid feeding pump described in the third aspect of the present invention, even if no special lubricant is applied between the inner surface of the peripheral wall of the first cylinder chamber and the outer periphery of the piston, the piston does not bite against the wall during operation (during use), but a smooth liquid feeding operation (a piston operation) can be attained for a long period of time under no lubricant and under a simple and inexpensive configuration and concurrently the resin material member arranged inside can be formed to have a thin wall thickness, a cost reduction as well as its small-sized configuration can be obtained.

In addition, liquid to be supplied is effectively cooled by the other cylinder chamber part while being fed, resulting in the fed liquid being efficiently cooled without applying any special cooling device. In the preferred embodiment, water with 18° C. at the water source could be cooled down to about 15° C. and supplied.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope and spirit of the invention as defined by the appended claims.

What is claimed is:

1. A liquid feeding pump which comprises:

first and second cylinders which are coaxially arranged and separated by a partition, said first cylinder including a head end wall opposite said partition and said second cylinder including a bottom end wall opposite said partition, a first piston movably positioned in said first cylinder to define a liquid chamber between said first piston and said head end wall and a first air chamber between said first piston and said partition, a second piston movably positioned in said second cylinder to define a second air chamber between said second piston and said partition and a third air chamber between said second piston and said bottom end wall, a rod extending through said partition and connecting said first and second pistons, first inlet and outlet means communicating with said first chamber for liquid, second inlet and outlet means communicating with said first air chamber, third inlet and outlet means communicating with said second air chamber, fourth inlet and outlet means communicating with said third air chamber, and means for passing liquid flowing to or from said first inlet and outlet means around an outer side of said second cylinder to cool said liquid, wherein when said liquid chamber contains liquid and said second air chamber is vented, supplying high pressure air to said first and third air chambers will cause said first and second pistons to move such that the first piston will discharge liquid from said liquid chamber through said first outlet means, while venting of said first and third air chambers and supplying high pressure air to said second air chamber will cause said first and second pistons to move such that the first piston will allow liquid to enter said liquid chamber through said first inlet means.

2. A liquid feeding pump according to claim 1, wherein said first cylinder has a smaller diameter than said second cylinder and said first piston has a correspondingly smaller diameter than said second piston.

3. A liquid feeding pump according to claim 1, wherein a side wall of at least one of said first and second cylinders comprises an inner resin member which is contacted by a piston within the cylinder and an outer metallic member.

4. A liquid feeding pump according to claim 1, wherein said means for passing liquid around an outer side of said second cylinder comprises a pipe which is connected to said first inlet and outlet means and is wound around said side of said second cylinder.

5. A liquid feeding pump according to claim 1, wherein said means for providing liquid around a side of said second cylinder comprises a cylindrical peripheral shell positioned around a side wall of said second cylinder to provide a liquid cooling chamber around said side wall, said shell including a liquid inlet port and a liquid outlet port.

6. A liquid feeding pump according to claim 5, including a pipe which extends from said first outlet means to said liquid inlet port.

* * * * *